US006945282B2

(12) United States Patent
Gendelman et al.

(10) Patent No.: US 6,945,282 B2
(45) Date of Patent: Sep. 20, 2005

(54) METHOD AND DEVICE FOR FORMING A SHED IN A WEAVING MACHINE

(76) Inventors: Mikhail Gendelman, deceased, late of Spartanburg, SC (US); by Flora Gendelman, legal representative, 109 Bagwell Farm Rd., Spartanburg, SC (US) 29302

( * ) Notice: Subject to any disclaimer, the term of this patent is extended or adjusted under 35 U.S.C. 154(b) by 389 days.

(21) Appl. No.: 10/172,932

(22) Filed: Jun. 17, 2002

(65) Prior Publication Data

US 2003/0230350 A1 Dec. 18, 2003

(51) Int. Cl.[7] ..... D03C 5/00

(52) U.S. Cl. ..... 139/78; 139/62; 139/99; 139/103; 139/317; 139/318; 364/470; 66/231; 66/232

(58) Field of Search ..... 364/470; 139/78, 139/62, 99, 103, 317, 318; 66/231, 232

(56) References Cited

U.S. PATENT DOCUMENTS

| | | | | |
|---|---|---|---|---|
| 3,137,322 A | | 6/1964 | Strake | |
| 3,586,061 A | * | 6/1971 | Lauritsen | 139/456 |
| 3,664,383 A | * | 5/1972 | Minchey et al. | 139/317 |
| 3,853,150 A | * | 12/1974 | Romano | 139/55.1 |
| 4,081,000 A | | 3/1978 | Wollenmann | |
| 4,183,382 A | | 1/1980 | Scheffel | |
| 4,290,460 A | | 9/1981 | Deborde | |
| 4,572,246 A | | 2/1986 | Ghiaro | |
| 4,756,342 A | | 7/1988 | Van Bogaert | |
| 4,932,442 A | | 6/1990 | Ishido et al. | |
| 5,031,672 A | | 7/1991 | Wahoud et al. | |
| 5,200,904 A | | 4/1993 | Tottman | |
| 5,390,709 A | * | 2/1995 | Martonffy | 139/456 |
| 5,487,413 A | * | 1/1996 | Hatakeyama et al. | 139/116.2 |
| 6,223,783 B1 | | 5/2001 | Peters et al. | |

FOREIGN PATENT DOCUMENTS

| | | |
|---|---|---|
| FR | 2783531 A1 | 3/2000 |
| SU | 735681 | 5/1980 |

OTHER PUBLICATIONS

Database WPI, Section Ch, Week 198104, Derwent Publications, Ltd., London, Great Britain, XP002263567 & SU 735 681 (Klimovsk Weave Equi)—Abstract, May 25, 1980. PCT Search Report, Jan. 02, 2004.

* cited by examiner

*Primary Examiner*—John J. Calvert
*Assistant Examiner*—Robert H. Muromoto, Jr.
(74) *Attorney, Agent, or Firm*—Dority & Manning, P.A.

(57) ABSTRACT

A shed-forming device and a method for using it are provided for creating a shed of warp yarns in a weaving machine. The shed-forming device includes a plurality of yarn separating elements operably disposed to one another within the weaving machine. The yarn separating elements individually separate the warp yarns into operational zones between the yarn separating element. A fluid supply apparatus supplies fluid to the yarn separating elements in the shed-forming device. The yarn separating elements direct the fluid to contact the warp yarns, forcing the warp yarns to form changeable sheds to allow proper weaving.

64 Claims, 9 Drawing Sheets

METHOD AND DEVICE FOR FORMING A SHED IN A WEAVING MACHINE

BACKGROUND OF THE INVENTION

The present invention relates to a method and device for forming a shed of warp yarns for filling insertion within a weaving machine. Shed-forming devices are well known in the art and have been used for thousands of years. Shed-forming devices in the past have been mechanical in nature.

The most common production weaving machines utilize a harness and cam system. The harnesses are frames with a plurality of heddles, each heddle having a warp yarn pass through its eye, thereby allowing the harness to control the warp yarns placed within its heddles. Usually anywhere between two to eight harnesses, each having different warp yarns within its heddles, are used within a weaving machine depending on the complexity of the pattern to be woven. The harness frames rest on oblong or other geometric-shaped cams that rotate off-center on an axis. As the cams turn, the harnesses raise and lower at different intervals within the weaving machine causing the warp yarns controlled by each harness to move with that harness as that harness rises and falls, thereby forming a shed of warp yarns for the insertion of filling yarns into the fabric.

The shed usually changes after each filling insertion, meaning that at least one harness must change from its current position to a new position. Therefore, in current typical production speeds in a wide range of weaving operations, the shed, and hence the harnesses' positions, change anywhere from 300 to 1500 times per minute depending on the weaving operation.

For more complex weaving patterns, a dobby system may be attached to the weaving machine to permit more control over the harnesses, and thus the shed.

A jacquard loom allows even more control of individual warp yarns, and thus allows the weaving of the most complex patterns. A jacquard head controls each individual heddle within a jacquard loom. A series of punch cards, or now a computer program, communicates to the jacquard head which heddles to raise and which to lower. Jacquard looms operate at a slower speed than the weaving machines utilizing harnesses.

The shed-forming operation in the current state of the art places a large amount of stress on the warp yarns. The tension created among the warp beam, the raising and lowering of the harnesses, and the take-up roll causes a relatively large amount of friction on the warp yarns as they travel over the edges of the heddle eyes in both weaving machines utilizing harnesses and jacquard looms. A slashing or sizing process in which the warp yarns are run through a sizing bath to add strength and reduce hairiness must occur on most fabrics before the warp yarns are beamed onto the warp beam used in the weaving process. In some incidences, the warp yarns are run through the slashing process more than once. This slashing process is time-consuming and the chemicals used are expensive. Even after the warp yarns are run through a slasher, warp breaks occur. These warp breaks are time-consuming to fix and can cause off quality fabrics which must be sold at reduced prices. Reducing the amount of chemicals used in slashing while decreasing the amount of warp breaks would be beneficial to any weaving operation.

Further, the shed-forming operation in the current state of the art is a bottle-neck to the weaving operation in many cases. In weaving machines that utilize air jet or water jet filling insertion mechanisms, the weaving operation is not limited to the speed of the filling insertion, but rather to the speed in which the harnesses can be raised or lowered to change the formation of the shed while not destroying the warp yarns. The production of a weaving machine could be dramatically increased if the speed at which a shed can be formed can be increased.

OBJECTS AND SUMMARY OF THE INVENTION

It is therefore a principal object of the present invention to provide an improved shed-forming device.

Another object of the present invention is to improve the quality of the woven fabrics that are woven on a weaving machine using the improved shed-forming device. An additional object of the present invention is to provide a shed-forming device which increases efficiencies of the weaving machines by reducing the number of warp breaks. Another object of the present invention is to reduce friction on the warp yarns and, thereby, in some incidences, allow a reduction in the amount of sizing chemicals needed to treat the yarn for the weaving process and the amount of time the warp yarns spend in the slashing process. A further object is to increase production speeds of the weaving machines.

Additional objects and advantages of the invention will be set forth in part in the following description, or may be obvious from the description, or may be learned through practice of the invention.

In accordance with the objects and purposes of the invention, a shed-forming device and a method for using it are provided for creating a shed of warp yarns in a weaving machine. The present invention is not particularly limited to any type of weaving machine and can be used to weave fabrics having complex pattern designs. The shed-forming device according to the invention includes a plurality of yarn separating elements operably disposed to one another within the weaving machine. The yarn separating elements individually separate the warp yarns into operational zones between the yarn separating element.

In a preferred embodiment, each yarn separating element can include a divider plate forming the base of the yarn separating element with upper and lower templates disposed thereto above and below the operational zone of that yarn separating element.

A fluid supply apparatus is configured with the plurality of yarn separating elements. The fluid supply apparatus supplies fluid to the yarn separating elements in the shed-forming device. The yarn separating elements direct the fluid to contact the warp yarns, forcing the warp yarns to form changeable sheds to allow proper weaving.

In a preferred embodiment, passageways are formed by the aligning of openings defined within upper and lower portions of the yarn separating elements disposed above and below the operational zones. Channels defined by the yarn separating elements can extend from specified openings, which form the passageways, to the operational zones between the yarn separating elements both above and below these operational zones. As fluid is provided to the passageways, the fluid flows through the channels into the operational zones between the yarn separating elements. Depending on the location the openings and the orientation of the channels, which extend from the openings, the warp yarns located in the operational zones between the yarn separating elements are forced into an upward or downward shed-forming position. The fluid supplied by the fluid supply apparatus may be air, water, or some other non-reactive substance.

In accord with a further embodiment of the present invention, a shed forming device includes a plurality of spaced yarn separating elements carried within a weaving machine. The spaced yarn separating elements define individually spaced operational zones through which warp yarns extend in yarn paths. A fluid supply source for supplying fluid is provided. A first fluid direction member is carried on an upper portion of each of the yarn separating elements. These first fluid direction members carried on the yarn separating elements direct fluid in a first direction. A second fluid direction member is also carried on each of the yarn separating elements. These second fluid direction members, however, are located on lower portions of the yarn separating elements. These second fluid direction members direct fluid in a second direction.

A plurality of valves are interposed between the fluid supply source and the first and second fluid direction members. A control operably connected to the valves for selectively opening and closing the valves to selectively supply fluid through the first and second fluid direction members. The fluid then strikes the warp yarns, forcing the warp yarns to form a shed by forcing selected warp yarns in the first direction and selected warp yarns in the second direction. The first and second fluid direction members may be fluid jets, such as air or water jets, or they may be channels in the yarn separating elements.

A method of the present invention for forming a shed for a weaving operation includes placing warp yarns into separate operational zones of a shed-forming device. Flows of fluids at predetermined intervals are then supplied to interact with the separated warp yarns. The flows of fluid are then directed to contact the separated warp yarns to force the separated warp yarns to move into shed-forming positions to allow filling yarn insertion through the formed shed.

In a preferred embodiment, the flows of fluid are directed from either above or below the individual yarns to push the warp yarns into a downward shed-forming position or an upward shed-forming position, respectively. The positions of the warp yarns can be changed by changing the location of the flows of fluid relative to the warp yarns.

Other features of the present invention will be described in greater detail below through the use of the appended figures.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
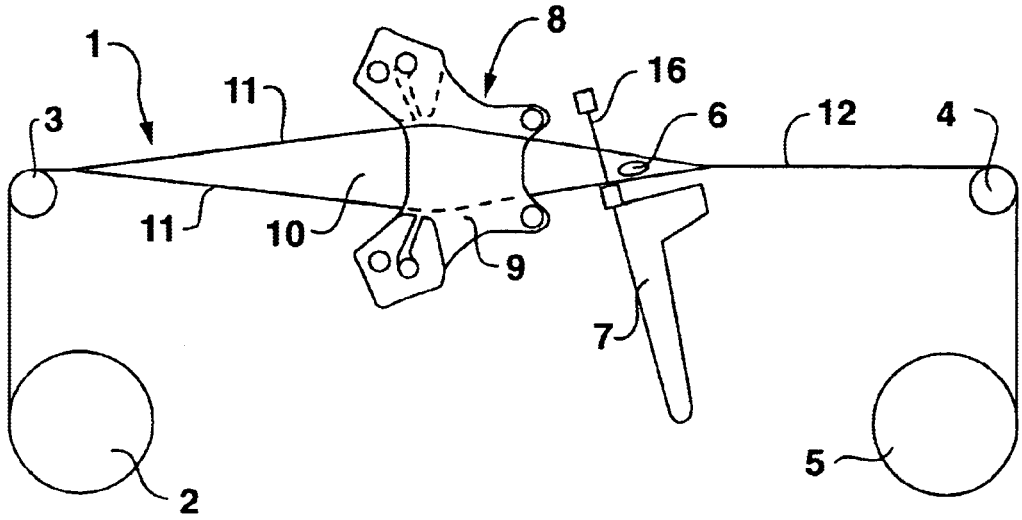
FIG. 1 is a schematic view of a weaving machine using a shed-forming device in accord with the invention.
Figure 2:
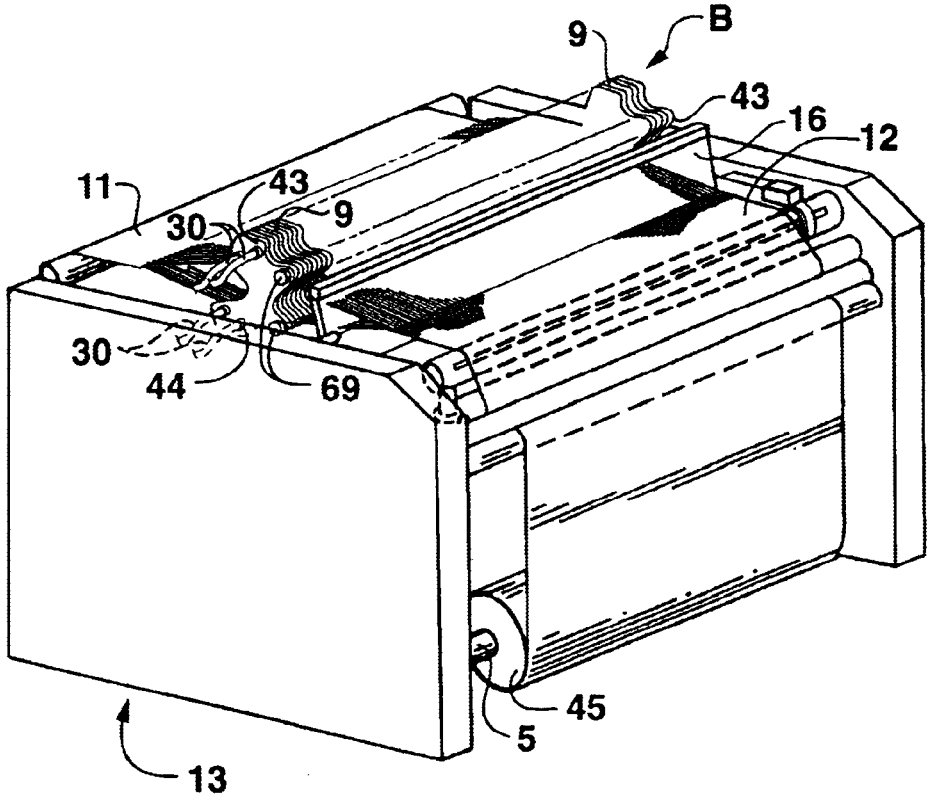
FIG. 2 is a perspective view of a weaving machine using a shed-forming device in accord with the invention.

FIG. 1 and FIG. 2 depict a schematic of a weaving machine generally designated by the reference character 1 with a cut-away view of a preferred embodiment of the present invention and a perspective view of a weaving machine generally designated by the reference character 13 with a preferred embodiment of the present invention installed in it. Warp yarns 11 are drawn over a tension bar 3 in parallel from a warp beam 2 by a take-up roll 5. A fluid is supplied to a shed-forming device generally designated by the reference character 8 via a fluid supply source or fluid supply apparatus 30. The fluid supply source 30 is connected to an outer frame 44 of the shed-forming device 8. The outer frame 44 is composed of two side elements 43. A plurality of yarn separating elements 9 are held together between the side elements 43 of the outer frame 44 by a set of fastening rods 69. Usually, the side elements 43 are a thicker dimension than the width of the yarn separating elements 9. The fluid is directed by a plurality of yarn separating elements 9 toward the warp yarns 11 pushing the warp yarns in an upward or downward direction depending on the yarn separating element orientation thereby forming a shed 10 of warp yarns 11.

A filling yarn travels into the shed in filling insertion area 6. The shed is changed by the shed-forming device 8, after which a beat-up 7 presses a reed 16 against the fabric 12 to insure the tightness of the fabric. Take-up roll 5 winds the fabric 12 onto a fabric roll 45 as the fabric is being woven. The tension placed on the warp yarn 11 between the warp beam 2, the tension bars 3, 4 and the take-up roll 5 can be great. Therefore, the force generated by the fluid on the warp yarns 11 as it is directed by the different yarn separating elements must be great enough to push the yarn into a shed in spite of the tension.

The use of a fluid, such as air or water, to force the warp yarns into the shed for inserting filling yarn into a woven fabric in a weaving process reduces the amount of friction on the warp yarn as compared to conventional mechanical means of forming sheds. Therefore, it is possible to reduce the number of warp breaks that occur in the weaving process. Further, the use of a fluid to create the shed in this manner allows for increased production speeds.

Figure 3A:
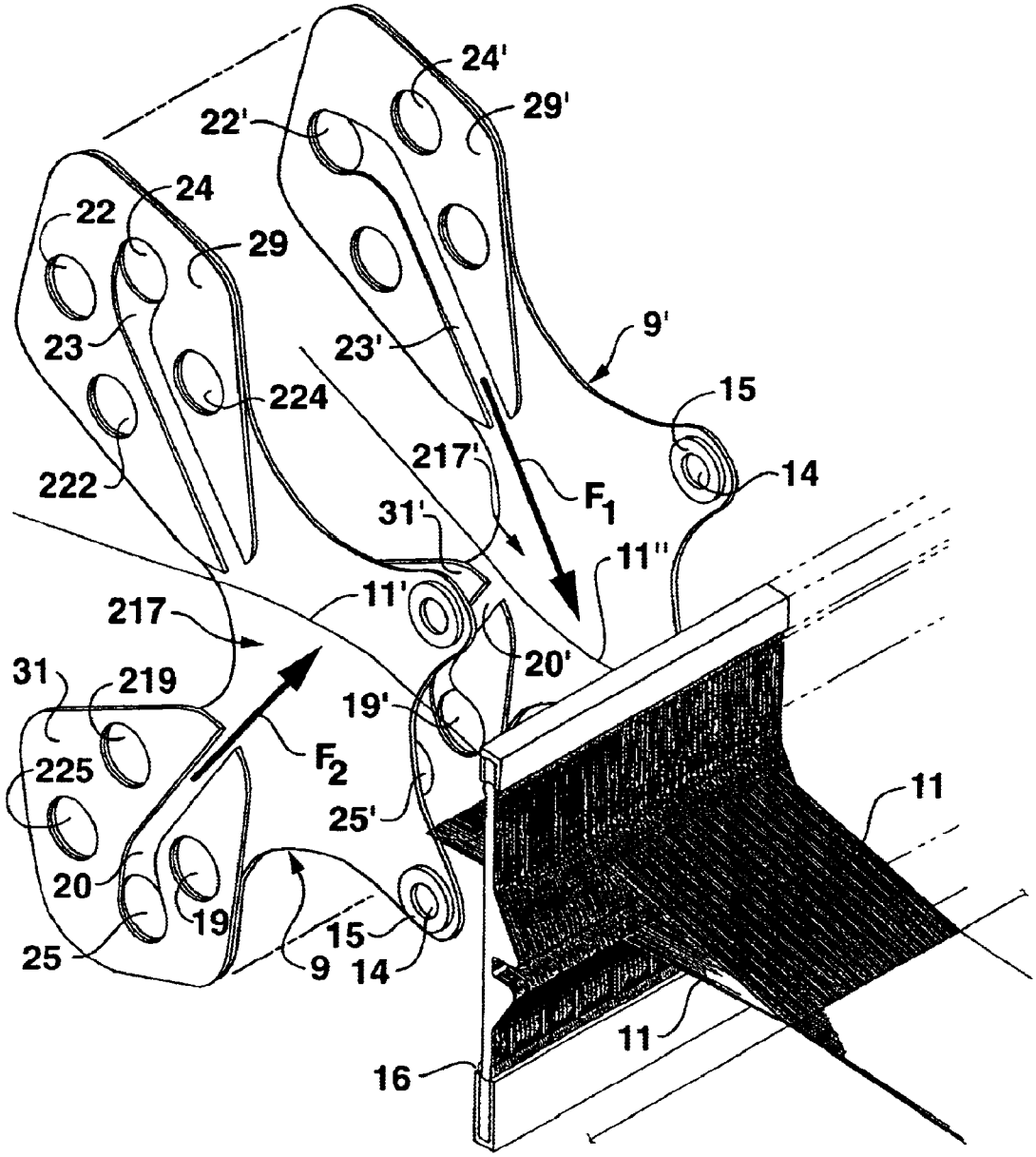
FIG. 3A is a perspective view of yarn separating elements directing fluid flows to shift warp yarns into shed-forming positions.
Figure 3B:
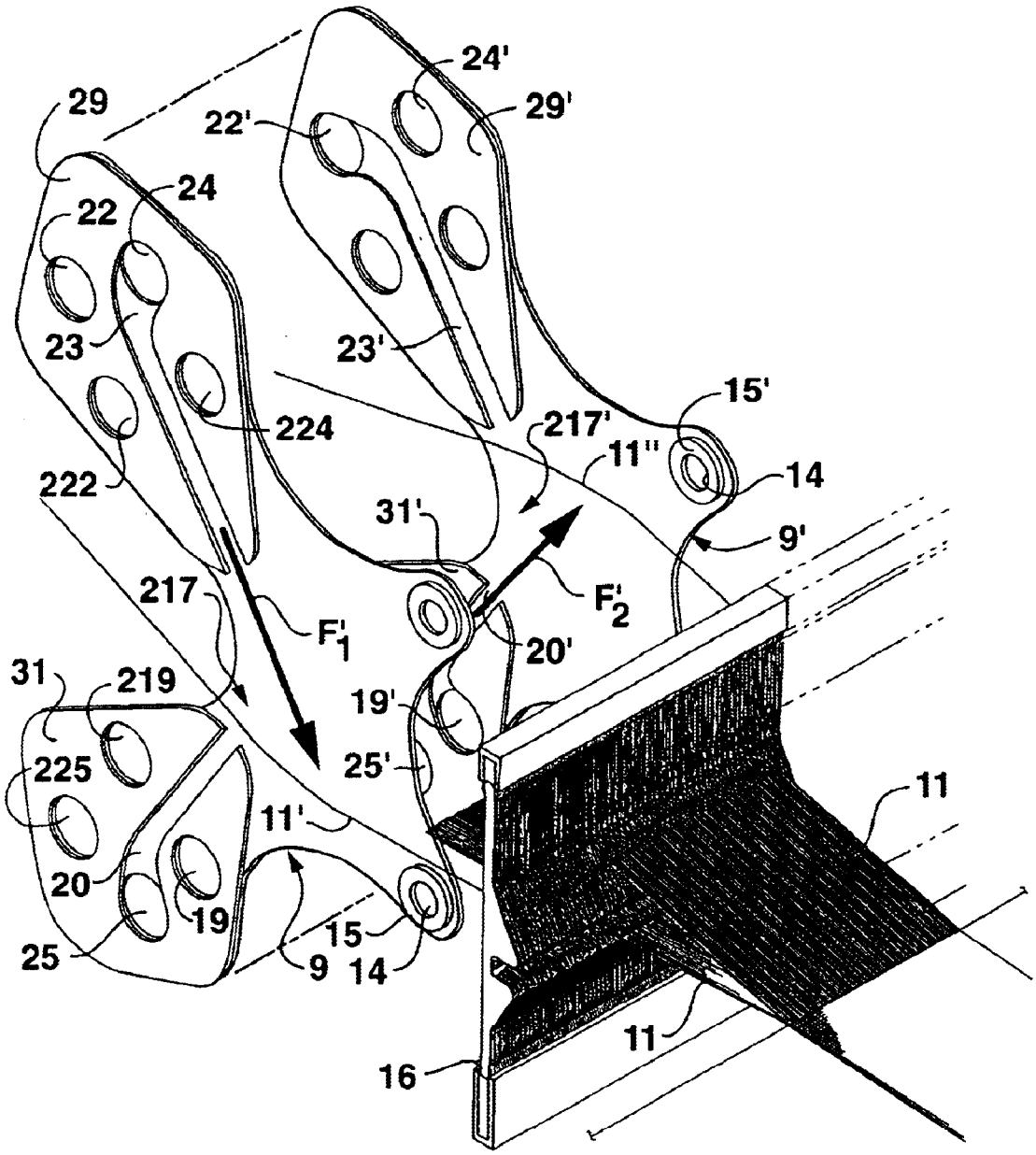
FIG. 3B is a perspective view of yarn separating elements directing fluid flows to shift warp yarns into shed-forming positions.

FIGS. 3A and 3B depict close-up examples of two yarn separating elements generally designated by reference characters 9, 9' taken from within the shed-forming device 8. These Figures show how each yarn separating element 9, 9' causes the fluid flow to interact with the warp yarns 11', 11", respectively. The yarn separating elements 9, 9' form openings 22, 24, 22', 24' in upper portions 29, 29' of the yarn separating elements 9, 9' and openings 19, 25, 19', 25' in lower portions 31, 31' of the same. These openings are aligned respectively to form passageways through which the fluid supplied by the fluid supply apparatus 30 travels during designated intervals.

A fluid direction member or channel 23 is formed by the yarn separating element 9 which extends from opening 24 defined in the yarn separating element 9 into an operational zone generally designated by reference character 217 between the yarn separating element 9 and, in this embodiment, the next adjacent yarn separating element. The operational zone 217 is located between the yarn separating element 9 and the next adjacent yarn separating element and between the upper portion 29 and lower portion 31.

The operational zone 217 is formed by the upper and lower portions 29, 31 of yarn separating element 9 abutting the next adjacent yarn separating element. The operational zones 217, 217' will be referred to as the operational zone 217, 217' of yarn separating element 9, 9', respectively. The upper portions 29, 29' and lower portions 31, 31' of the yarn separating elements 9, 9' in this embodiment are thicker than the portion of the yarn separating elements 9, 9' which form the operational zones 217, 217' of the yarn separating elements 9, 9'.

The fluid direction member or channel 23 extends from the opening 24 through the upper portion 29 to the operational zone 217 of the yarn separating element 9. Likewise, a channel 23' is formed in yarn separating element 9' and extends through upper portion 29' to the operational zone 217' of yarn separating element 9'. Similarly, the yarn separating elements 9, 9' form fluid direction members or channels 20, 20' leading from openings 25, 19' to the operational zones 217, 217' of the yarn separating elements 9, 9' through lower portions 31, 31', respectively.

In this embodiment, the fluid direction members are channels, however, other structures, for example fluid jets, may be used. Such fluid jets would be preferably air jets or water jets. When fluid jets are used, the yarn separating elements do not necessarily need to form passageways of openings in the yarn separating elements.

The yarn separating elements 9 within the shed-forming device must be securely fastened to each other to insure the passageways created by the openings formed by the yarn separating elements are leak proof. Yarn separating elements 9, 9' form fastening apertures 14 through which the fastening rods 69 (see FIG. 2) pass. Spacer elements 15 are shown around the aperture 14. The thickness of these spacer elements 15 corresponds to the thickness of the upper portions 29, 29' and the lower portions 31, 31' of the yarn separating elements 9, 9' minus the thickness to the portion of the yarn separating elements 9, 9' that form the operational zone 217, 217', respectively. The spacer elements 15 insure an even and secure fit of the yarn separating elements as the fastening rods 69 are tightened. The fastening rods 69 may be more in number and may be placed in other locations. The spacer elements 15 may be a physical part of the yarn separating element or it may be an individual element as illustrated here.

In FIG. 3A, when the fluid flows in the passageway created by openings aligned with openings 22, 22' in the upper portions 29, 29', a portion of fluid travels down the channel 23' as shown as fluid flow $F_1$. The fluid flow $F_1$ pushes warp yarn 11" into a downward shed-forming position. Simultaneously, as fluid flows through the passageway created by openings aligned with openings 25, 25', a portion of fluid travels through the channel 20 as shown as fluid flow $F_2$. The fluid flow $F_2$ pushes warp yarn 11' into an upward shed-forming position.

FIG. 3B demonstrates the change of the shed-forming position of the warp yarns 11', 11". When the fluid flows through the passageway created by openings aligned with openings 19, 19', a portion of fluid travels down the channel 20' as shown as fluid flow $F_2'$. The fluid flow $F_2'$ pushes warp yarn 11" into an upward shed-forming position. Simultaneously, as fluid flows in the passageway created by openings aligned with openings 24, 24' in the upper portions 29, 29', a portion of fluid travels down the channel 23 as shown as fluid flow $F_1'$. The fluid flow $F_1'$ pushes warp yarn 11' into a downward shed-forming position.

A plurality of yarn separating elements 9, 9' can alternate within the shed-forming device to create sheds to weave a plain weave pattern, for example. The fluid flows depicted in FIGS. 3A and 3B and described above would alternate to create sheds to weave such a pattern. In this embodiment, the complexity of the patterns that can be woven on a weaving machine utilizing a shed-forming device of the present invention is determined by the number of openings formed within the yarn separating elements 9 which created passageways and channels in which fluid provided by a fluid supply apparatus 30 can flow.

In this embodiment, these yarn separating elements 9 which form the passageways and channels in essence work like heddles in that each yarn separating element 9 has an upper opening with a channel and a corresponding lower opening with a channel that work in tandem to lower and raise the warp yarn as fluid travels through the respective passageways and channels. The upper opening with a channel operates in inverse relation to its corresponding lower opening with a channel in that, when fluid is flowing through the passageway that feeds the channel of the upper opening, fluid is not flowing in the passageway that feeds the channel of the lower opening and vice versa. Each passageway created by the openings defined by the yarn separating elements 9 feed fluid only to those warp yarns within the operational zone of a yarn separating element with a channel extending from its opening creating that passageway to the operational zone. Thus, each upper passageway and its corresponding lower passageway controls a set of warp yarns in a similar manner to a harness in conventional weaving machines.

In the yarn separating element 9 illustrated in FIGS. 3A and 3B, there are four possible sets of warp yarns created by the openings, channels and passageways formed by a plurality of yarn separating elements 9. Upper openings 22, 24, 222, 224 each have an inversely corresponding lower opening 19, 25, 219, 225, meaning that if a channel 23 is present between upper opening 24 and operational zone 217, then a channel 20 is present between lower opening 25 and operational zone 217. Likewise, in the present example, upper opening 22 has a corresponding lower opening 19. By arranging a plurality of yarn separating elements 9, each having a channel leading from the different upper openings 22, 24, 222, 224 and from their corresponding lower openings 19, 25, 219, 225, different sheds can be formed by the four sets of warp yarns within the operational zones 217 of the yarn separating elements 9 to allow weaving of different patterns.

The more openings, and thus passageways, defined within the yarn separating elements 9, the more complex the pattern to be woven can be. Therefore, yarn separating elements possessing more than four upper and four lower openings can create sheds to weave a more complex fabric.

Figure 4:
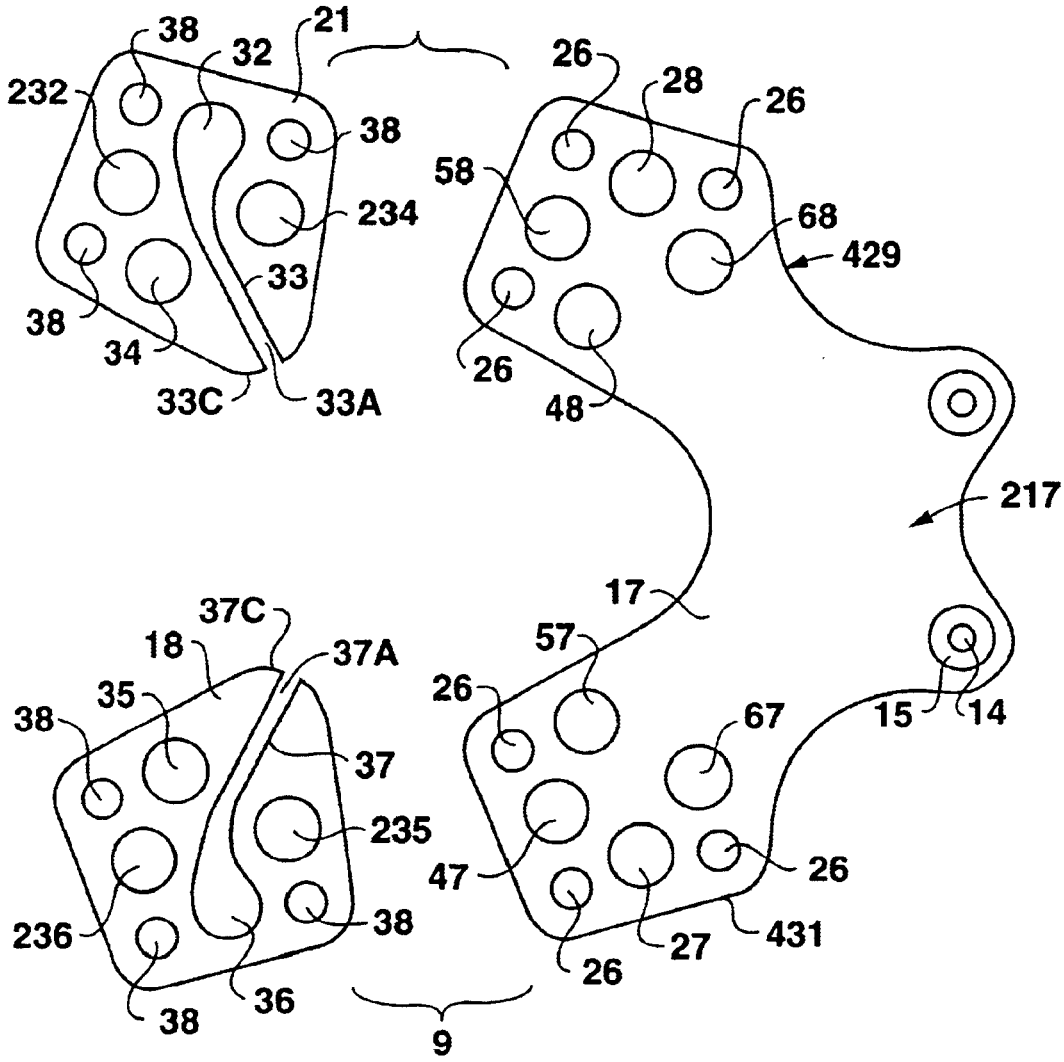
FIG. 4 is a side view of an upper and lower template and divider plate which form an embodiment of a yarn separating element.

FIG. 4 depicts an advantageous embodiment of a yarn separating element 9. The yarn separating element 9 may be comprised of a flat divider plate 17 with upper template 21 and lower template 18 disposed to the divider plate 17. FIG. 4 shows the templates 18, 21 isolated from the divider plate 17. The divider plate possesses an upper portion 429 and a lower portion 431. The upper portion 429 forms in this example four upper openings 28, 48, 58, 68 and the lower portion 431 forms four lower openings 27, 47, 57, 67. The upper template 21 forms upper openings 32, 34, 232, 234 and lower template 18 forms lower openings 35, 36, 235, 236. A channel 33 in the upper template 21, shown here as extending from the upper opening 32 through the edge of the template 21, may extend from any of the upper openings 32, 34, 232, 234. A channel 37 in the lower template 18, shown here as extending from the lower opening 36 through the edge of the template 18, may extend from any of the lower openings 35, 36, 235, 236. The channels 33, 37 penetrate through the width of the templates 21, 18 to form a narrow aperture through the templates 21, 18 from the respective openings 32, 34, 232, 234, 35, 36, 235, 236 from which they extend through the edge of the templates 21, 18.

The openings defined in the upper portion 29 and lower portion 31 of the divider plate 17 respectively align with the openings defined in the upper template 21 and the lower template 18 in such a manner that the channel 33, 37 extend into the operational zone 217 and thus forming a yarn separating element 9. As with the yarn separating element 9 of FIGS. 3A and 3B, the divider plates 17 and their respective templates 21, 18 form yarn separating elements 9 that can be aligned to form passageways through which fluid from a fluid supply apparatus can flow. The divider plates and templates 21, 18 should be secured in their proper position to insure alignment of their respective openings. Fastening apertures 26 and fastening apertures 38 are defined by the divider plate 17 and the upper template 21 and lower template 18, respectively. Additional fastening rods may be inserted into the aligned apertures 26, 38 to secure the templates 21, 18 and divider plates 17 in proper position. However, other fastening means may be used as well.

As with the yarn separating elements 9, divider plates 17 can form fastening apertures 14 through which the fastening rods 69 (see FIG. 2) pass. Spacer elements 15 are shown around the aperture 14. The thickness of these spacer elements 15 corresponds to the thickness of the upper templates 21 and the lower templates 18. The spacer elements 15 insure an even fit of the templates 21, 18 and the divider plates 17 as the fastening rods 69 are tightened. The spacer elements 15 may be a physical part of the templates 21, 18 or divider plates 17 or they may be individual elements.

Figure 5A:
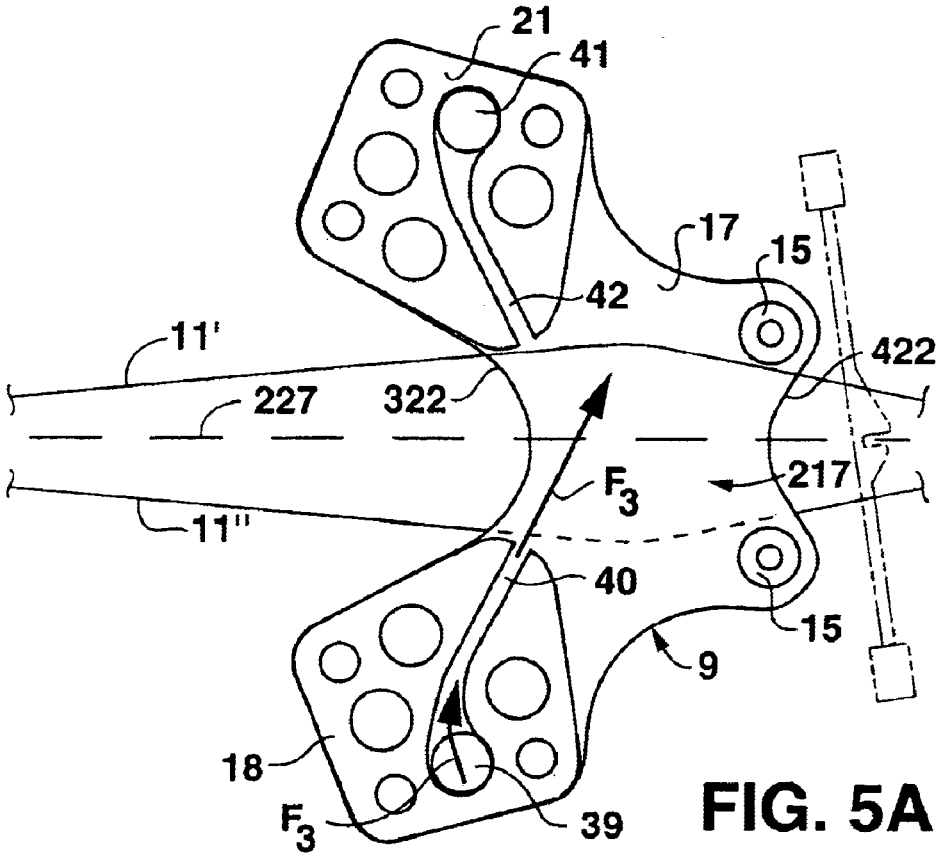
FIG. 5A is a side view of templates and a divider plate directing a fluid flow to shift a warp yarn into an upward shed position.
Figure 5B:
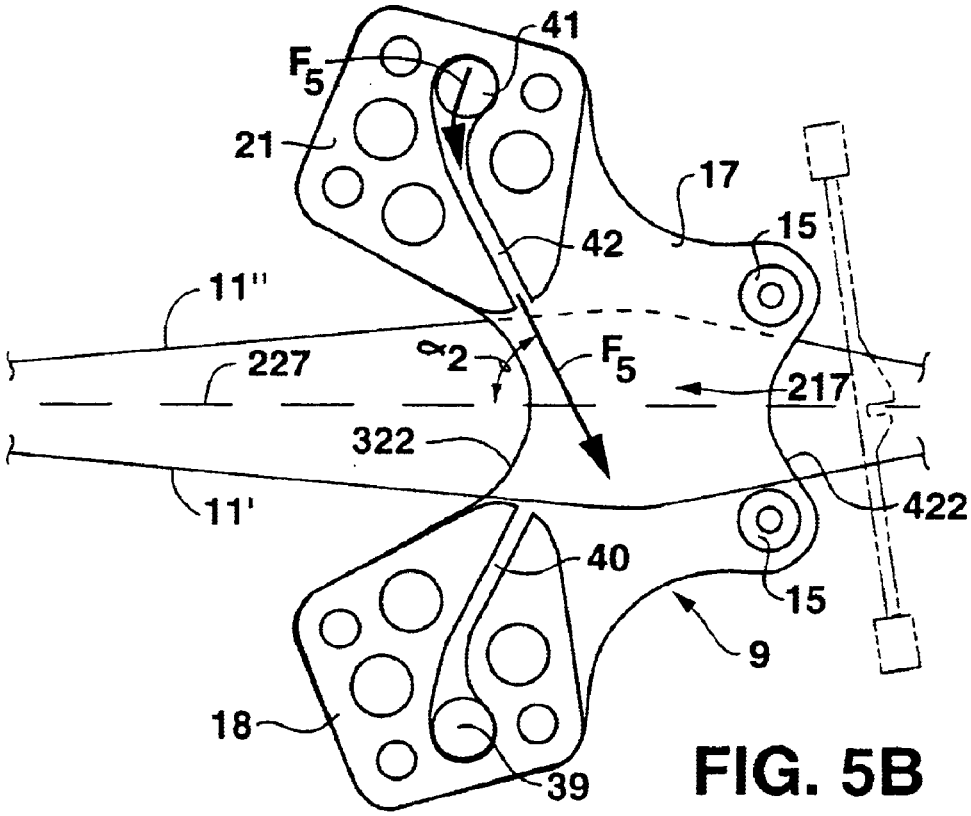
FIG. 5B is a side view of templates and a divider plate directing a fluid flow to shift a warp yarn into a downward shed position.

In this embodiment, the flow of the fluid supplied to the passageway created by the alignment of the openings defined by the templates 21, 18 and divider plates 17 and how that flow of fluid is directed to the warp yarns is illustrated by FIGS. 5A and 5B. The openings of the templates 21, 18 and divider plates 17 are aligned to define passageways therethrough, such as upper passageway 41 and lower passageway 39, to provide a fluid flow to force the warp yarns 11 into a shed. As discussed above, lower passageway 39 corresponds to the upper passageway 41 in such a manner that when fluid flows through passageway 41, no fluid flows through passageway 39. As a fluid flow travels through the passageway 39, portions of the fluid flow $F_3$ travel down the channel 40. The channel 40 directs the fluid flow $F_3$ into the operational zone 217 where fluid flow $F_3$ contacts the warp yarn 11' pushing the warp yarn 11' into an upward shed-forming position.

Conversely, as the fluid flow travels through the passageway 41, portions of the fluid flow $F_5$ travel down the channel 42. The channel 42 directs the fluid flow $F_5$ into the operational zone 217 where fluid flow $F_5$ contacts the warp yarn 11' pushing the warp yarn 11' into an downward shed-forming position.

In the particular embodiment illustrated in FIG. 4, templates 18, 21 are four-sided in a generally diamond shape with the corners rounded. Opening 32 in the upper template 21 and opening 36 in the lower template 18 are enlarged lobes. Channel 33 extends outwardly from the enlarged lobe 32 in a narrow aperture to a mouth 33A at a corner 33C. Channel 37 extends outwardly from the enlarged lobe 36 in a narrow aperture to a mouth 37A at a corner 37C. The templates, however, may have other shapes and designs which suit specific or general purposes.

When the openings of the upper and lower templates are aligned with the divider plates, the mouth of the respective channels is direct to the path that the warp yarns travel through the operational zone as seen in FIGS. 5A and 5B. The fluid path from the channel 40 of the lower template creates an acute angle $\alpha_1$ with the unaltered warp yarn path 227, while the fluid path from the channel 42 of the upper template creates an acute angle $\alpha_2$. The path 227 is positioned between the spacer elements 15. Again, other angles formed by the fluid path and the yarn path may be desirable, and are covered by this invention.

The divider plate 17 in this particular embodiment possesses an inward curved shape 322 at the entrance and an inward curved shape 422 at the exit of the warp yarn path into the operational zone 217. The entrance curve 322 of the divider plate 17 extends in an acute angle, while the exit curve 422 of the divider plate 17 extends in an obtuse angle. However, it may be desirable to have the entrance curve 322 extending in an obtuse angle as well as the exit curve 422 extending in an acute angle.

As stated above, the complexity of the possible patterns that can be woven depends on the number of possible sheds that can be formed within the weaving machine. In the illustrated embodiments, the number of sheds, which can be formed by the shed-forming device 8, depends upon the number of passageways formed by the openings defined by the templates 21, 18 and divider plates 17, as well as the channels defined by the templates 21, 18. In other embodiments, it may be possible to use yarns separating elements having a manifold with divider plates and only use one passageway with constant fluid flow to weave complex patterns.

FIGS. 6A, 6B, 6C, and 6D illustrate an advantageous embodiment in which the templates form four openings to be aligned with openings defined in upper and lower portions of the divider plates to form four passageways above and four passageways below the warp yarns.

Figure 6A:
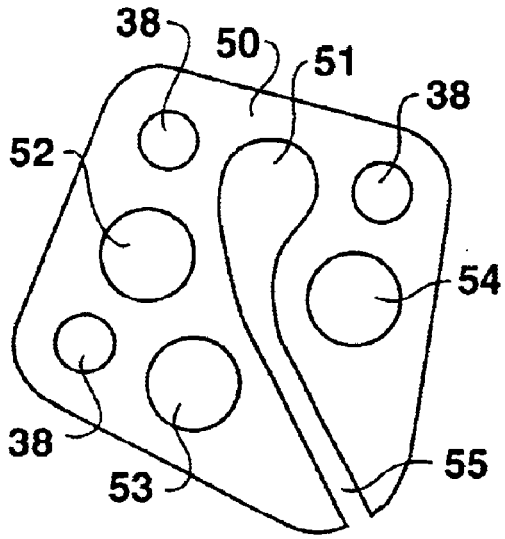
FIG. 6A is a side view of a template having a channel extending from a right first opening.
Figure 6B:
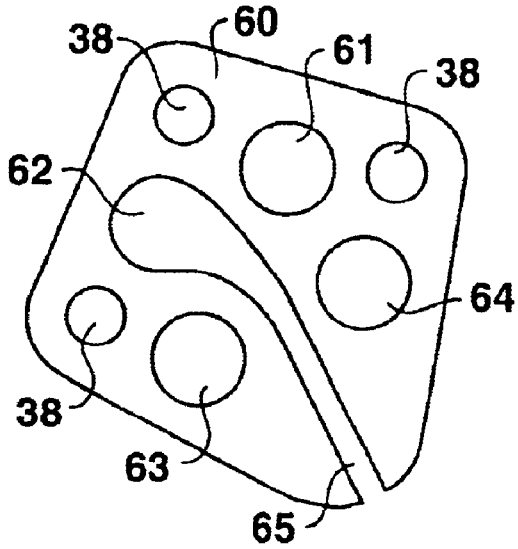
FIG. 6B is a side view of a template having a channel extending from a left first opening.
Figure 6C:
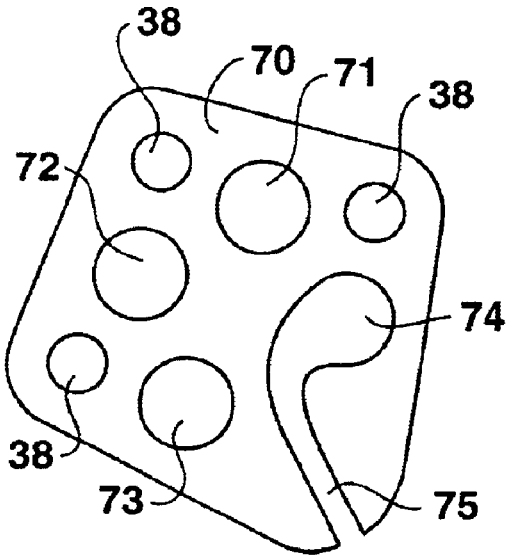
FIG. 6C is a side view of a template having a channel extending from a right second opening.
Figure 6D:
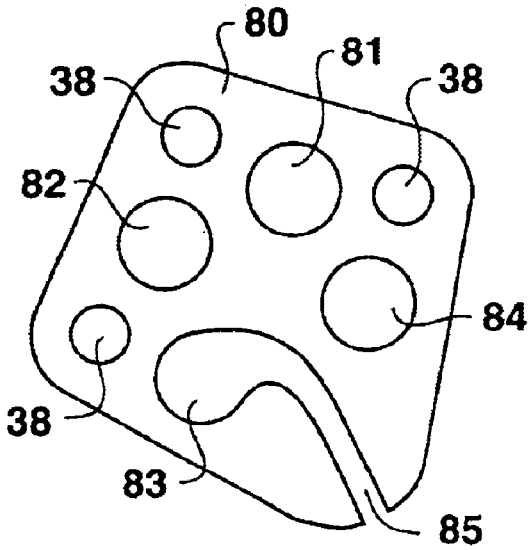
FIG. 6D is a side view of a template having a channel extending from a left second opening.

The template embodiments depicted in FIGS. 6A, 6B, 6C, and 6D may be used as either upper or lower templates within the shed-forming device 8. Template 50, shown in FIG. 6A, defines four openings 51, 52, 53, 54. Channel 55 is defined by template 50 by forming a narrow aperture from the right first opening 51 to an outlet at an edge of template 50. Template 60, shown in FIG. 6B, defines four openings 61, 62, 63, 64. Channel 65 is defined by template 60 by forming a narrow aperture from the left first opening 62 to an outlet at an edge of template 60. FIG. 6C illustrates template 70 defining four openings 71, 72, 73, 74 along with channel 75. Channel 75 is formed as the to previous channels 55, 65 with the channel 75 being shorter, extending from the right second opening 74 to an outlet at an edge of template 70. Template 80 defines four openings 81, 82, 83, 84 along with channel 85 as shown in FIG. 6D. Channel 85, extending from the left second opening 83 to an outlet at an edge of template 70, is formed in the same manner as the previous channels 55, 65, 75.

The use of the templates 50, 60, 70, 80 along with the corresponding divider plates 17 allow the possible grouping of the warp yarns into four sets as described above regarding the yarn separating elements 9. The templates 50, 60, 70, 80 can be used as both an upper and a lower template. It may be desirable to use the template with the same channel pattern in both the lower portion and the upper portion on the same divider plate so that the upper openings and corresponding lower openings and thus the passageways created by these openings are easier to identify to insure proper creation of the sheds. However, as is illustrated in FIGS. 3A and 3B and will be discussed regarding FIGS. 8A and 8B, this matching of templates is not necessary.

Figure 7A:
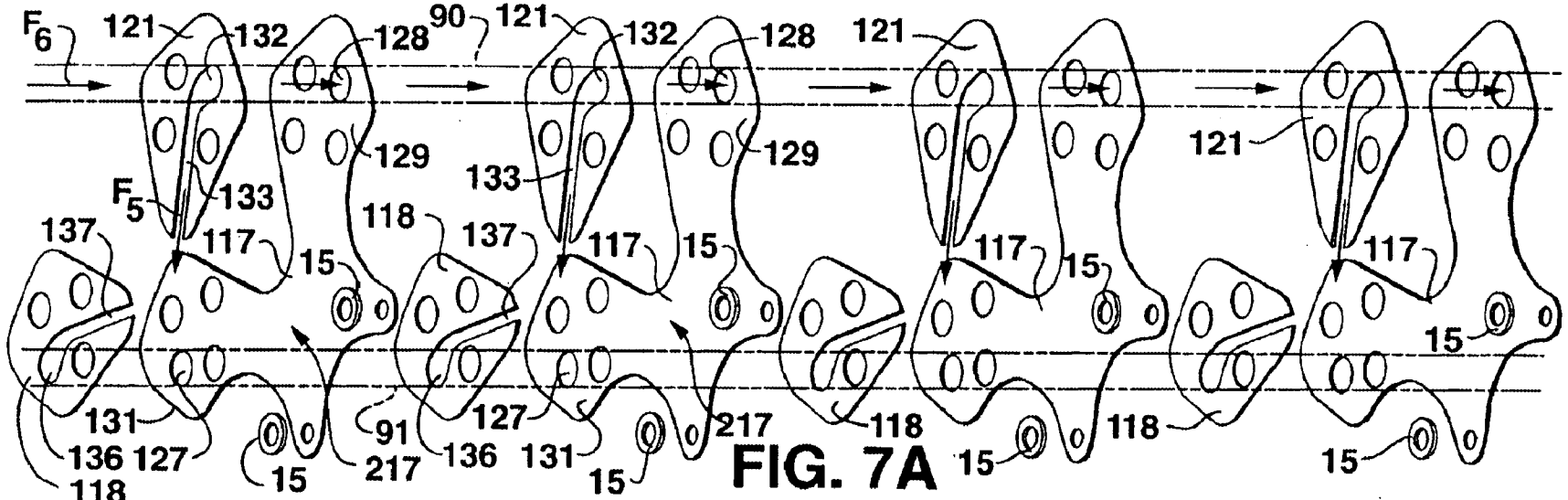
FIG. 7A is an explode view of an embodiment of yarn separating elements which control a set of warp yarns.
Figure 7B:
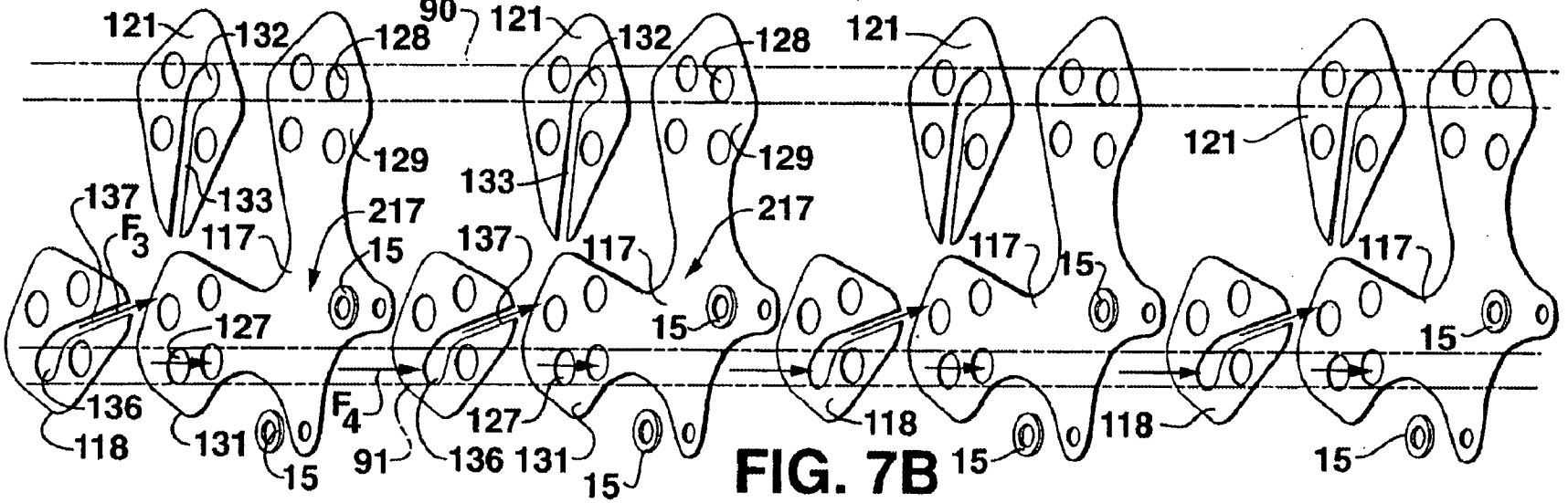
FIG. 7B is an exploded view of an embodiment of yarn separating elements which control a set of warp yarns.

FIGS. 7A and 7B depict an exploded view of a series of yarn separating elements composed of divider plates 117, templates 121, 118 and spacer elements 15. These divider plates 117 and templates 121, 118 control a set of warp yarns and are dispersed among a plurality of other yarn separating elements composed of divider plates and different patterned templates. A passageway 90 is formed by the alignment of openings 132 defined by the templates 121, openings 128 defined by the divider plates 117 and openings defined by the other templates and divider plates in the upper portions 129 of the divider plates 117. As a fluid flow $F_6$ passes through the passageway 90, fluid flow portions $F_5$ travel down channels 133 extending from the openings 132 defined by templates 121 into the operational zones 217. The fluid flows $F_5$ contact the warp yarns located within the operational zones 217, pushing this set of warp yarns into a downward shed position.

Once it is time for this set of warp yarns to change its position within the shed, the fluid flow $F_6$ is terminated and a new fluid flow $F_4$ is started within a passageway 91 corresponding to passageway 90. Passageway 91 is formed by the alignment of openings 136 defined by the templates 118, openings 127 defined by the divider plates 117 and openings defined by the other templates and divider plates in the lower portions 131 of the divider plates 117. As a fluid flow $F_4$ passes through the passageway 91, fluid flow portions $F_3$ travel up channels 137 extending from the openings 136 defined by templates 118 into the operational zones 217. The fluid flows $F_3$ contact the warp yarns located within the operational zones 217, pushing this set of warp yarns into an upward shed position.

Other divider plates and templates possessing different channel patterns control their associated sets of warp yarn in a similar manner, thereby allowing the shed to be changeable.

Figure 8A:
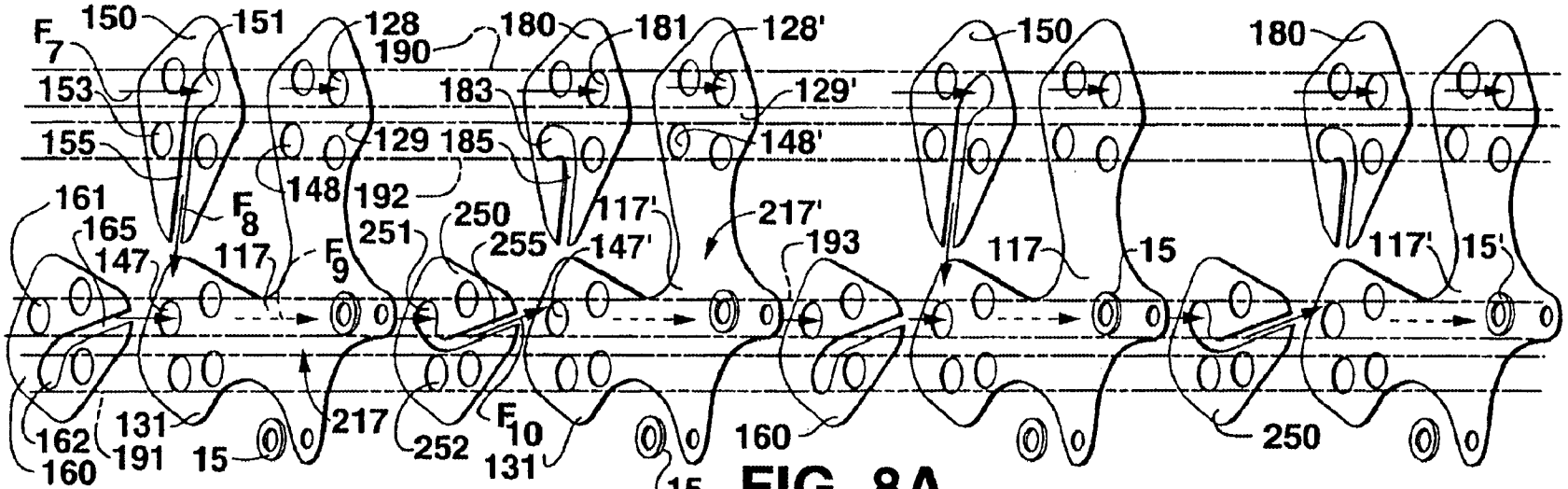
FIG. 8A is an exploded view of a portion of a shed-forming device according to the invention.
Figure 8B:
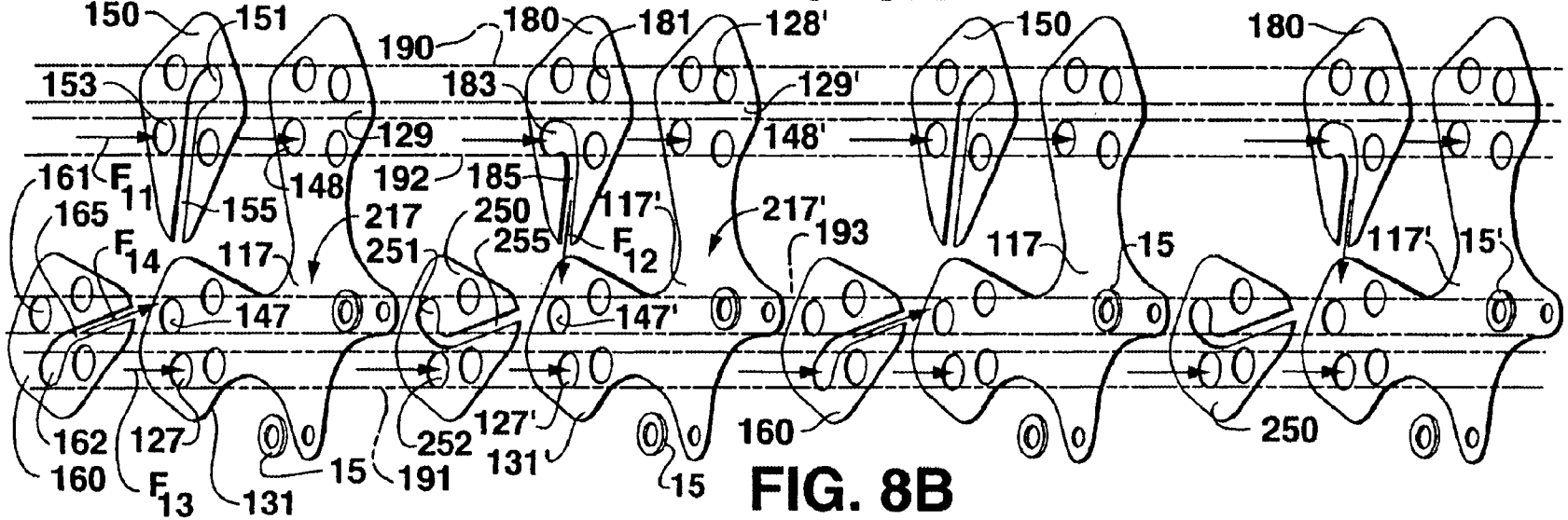
FIG. 8B is an exploded view of a portion of a shed-forming device according to the invention.

FIGS. 8A and 8B illustrate an exploded perspective view of an example of portion of a shed forming device that can be used in weaving a plain weave pattern. A plain weave pattern is chosen here for simplicity of explanation. However, more complex patterns can be woven on weaving machines utilizing the embodiments of the present invention described herein.

An upper passageway 190 is formed by the alignment of openings 151, 181 defined by the templates 150, 180, and openings 128, 128' defined by the divider plates 117, 117' in the upper portions 129, 129' of the divider plates 117, 117'. Likewise, a lower passageway 193 is formed by the alignment of openings 161, 251 defined by the templates 160, 250, and openings 147, 147' defined by the divider plates 117, 117' in the lower portions 131, 131' of the divider plates 117, 117'.

As a fluid flow $F_7$ passes through the upper passageway 190, fluid flow portions $F_8$ travel down channels 155 extending from the openings 151 defined by templates 150 into the operational zones 217. The fluid flows $F_8$ contact the warp yarns located within the operational zones 217, pushing these warp yarns into a downward shed position. At the same time, a fluid flow $F_9$ passes through the lower passageway 193. Fluid flow portions $F_{10}$ travel up channels 255 extending from the openings 251 defined by templates 250 into the operational zones 217'. The fluid flows $F_{10}$ contact the warp yarns located within the operational zones 217', pushing these warp yarns into an upward shed position.

After filling insertion has occurred, the shed changes by having the warp yarns change positions. At this time, the fluid flows $F_7$, $F_9$ within the passageways 190, 193 are terminated, while new fluid flows $F_{11}$, $F_{13}$ are activated within passageways 191, 192 that correspond to the passageways 190, 193, respectively. Upper passageway 192 is formed by the alignment of openings 153, 183 defined by the templates 150, 180, and openings 148, 148' defined by the divider plates 117, 117' in the upper portions 129, 129' of the divider plates 117, 117'. Upper passageway 192 corresponds to lower passageway 193 in an inverse manner, in that when the fluid flows through passageway 192, it does not flow through passageway 193 and vice versa. Likewise, a lower passageway 191, inversely corresponding to passageway 190, is formed by the alignment of openings 162, 252 defined by the templates 160, 250, and openings 127, 127' defined by the divider plates 117, 117' in the lower portions 131, 131' of the divider plates 117, 117'. Lower passageway 191 corresponds to upper passageway 190 in an inverse manner, in that when the fluid flows through passageway 191, it does not flow through passageway 190 and vice versa.

As a fluid flow $F_{11}$ passes through the upper passageway 192, fluid flow portions $F_{12}$ travel down channels 185 extending from the openings 183 defined by templates 180 into the operational zones 217'. The fluid flows $F_{12}$ contact the warp yarns located within the operational zones 217', pushing these warp yarns into a downward shed position. At the same time, a fluid flow $F_{13}$ passes through the lower passageway 191. Fluid flow portions $F_{14}$ travel up channels 165 extending from the openings 162 defined by templates 160 into the operational zones 217. The fluid flows $F_{14}$ contact the warp yarns located within the operational zones 217, pushing these warp yarns into an upward shed position.

By shifting or changing the fluid flows between the passageways 190, 191, 192, 193 in the manner described above, the sheds for weaving a plain weave pattern are formed. After each filling insertion, the warp yarns change their shed position by the changing of the fluid flows between the passageways 190, 191, 192, 193. In this manner, a plain weave fabric can be woven. By the utilization of more passageways formed by openings defined by templates and divider plates, more complex fabrics can be woven.

Figure 9:
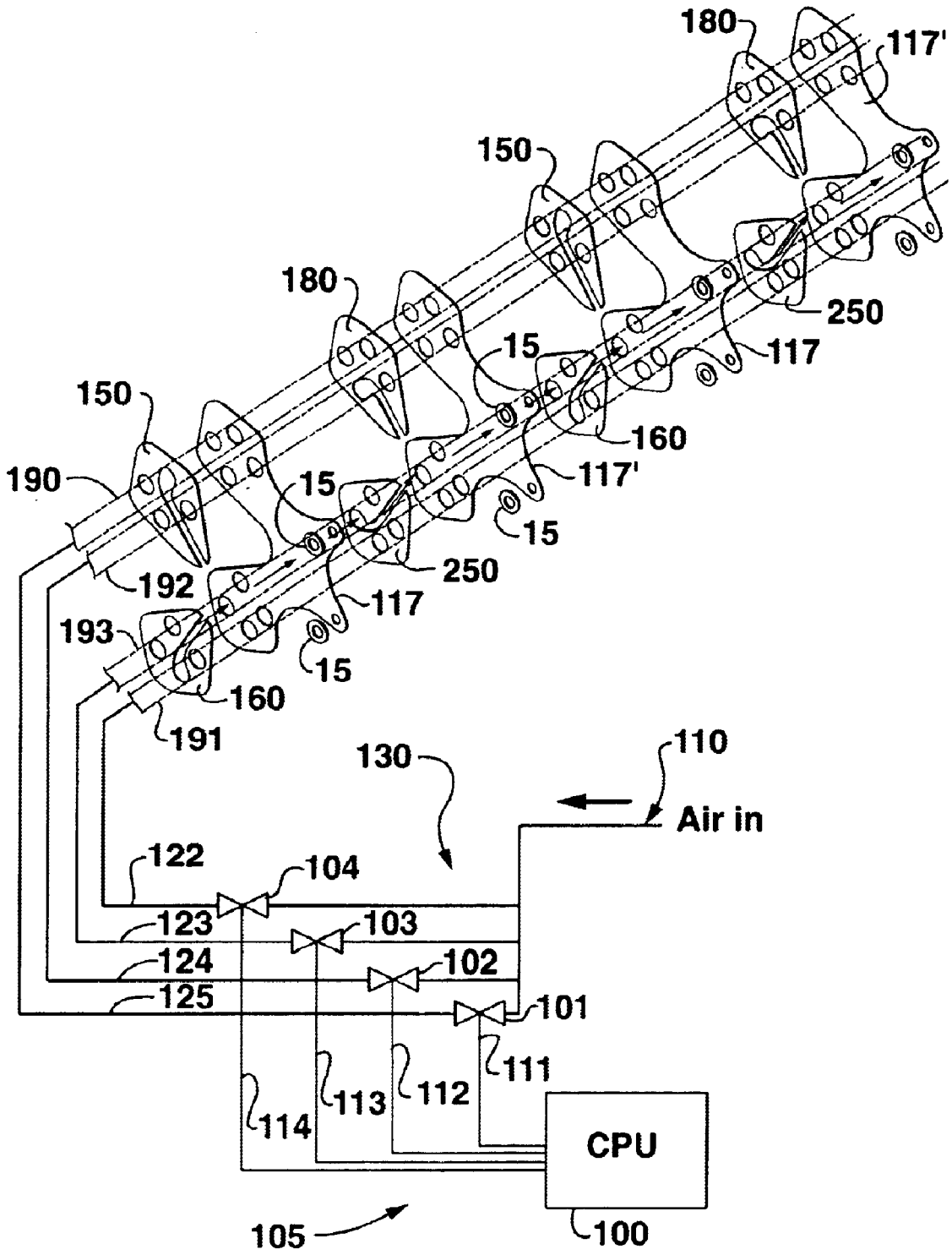
FIG. 9 is a schematic view of a control device for controlling fluid flow to the shed-forming device.

To control the fluid flow between the passageways formed by openings in the yarn separating elements, a control device can be operably linked to the fluid supply apparatus. FIG. 9 depicts such a control device generally designated by reference character 105 in communication with an air supply apparatus 130. The air supply apparatus 130 possesses an air supply 110 which feed air lines 122, 123, 124, 125. Air lines 122, 123, 124, 125 are in communication with passageways 191, 193, 192, 190 formed by the openings defined in templates 160, 250, 150, 180 and divider plates 117, 117', respectively. Air line 122 feeds passageway 191, air line 123 feeds passageway 193, air line 124 feeds passageway 192, and air line 125 feeds passageway 190.

In this preferred embodiment, control device 105 includes a control 100, lines 111, 112, 113, 114 and control valves 104, 103, 102, 101. Control valves 104, 103, 102, 101 are disposed on air lines 122, 123, 124, 125, respectively. The control 100, shown here as a central processing unit (CPU), is connected to these control valves 101, 102, 103, 104 by lines 111, 112, 113, 114. The CPU 100 controls the control valves 101, 102, 103, 104 through the lines 111, 112, 113, 114, wherein line 111 is in communication with control valve 101, line 112 is in communication with control valve 102, line 113 is in communication with control valve 103, and line 114 is in communication with control valve 104.

In FIG. 9, air is flowing through only passageway 193. The control, in this example, has opened control valve 103 allowing air line 123 to supply air to passageway 193. The control, however, has closed control valve 101, control valve 102, and control valve 104, thereby stopping the flow of air through air lines 125, 124, 122 and thus passageways 190, 192, 191, respectively.

In a further example, a shed-forming device which utilizes two upper passageways 190, 192 and their corresponding lower passageways 191, 193 to form a shed for weaving a plain weave pattern are described for the sake of simplicity. When the air is to be supplied to passageway 190 and passageway 193, the control 100 opens the control valve 103 which is disposed to air line 123 in communication with passageway 193 and the control valve 101 disposed on air line 125 which is connected to passageway 190. Simultaneously, the control 100 closes the control valve 102 disposed on air line 124 and closes the control valve 104 disposed on air line 122 to prevent air flow through passageway 192 and passageway 191. A shed is formed by the air flow in passageways 190, 193 through which a filling yarn is inserted.

After the filling yarn is inserted, the control 100 closes the control valve 103 and control valve 101, thereby terminating the air flow through passageway 193 and passageway 190 from air line 123 and air line 125. At the same instance, the control 100 opens control valve 104 and control valve 102, thereby supplying air to passageway 191 and passageway 192 through air line 104 and airline 102. Since passageway 191 corresponds to passageway 190 and passageway 192 corresponds to passageway 193, the air flow through passageway 191 and passageway 192 and the termination of the air flow through passageway 190 and passageway 193 cause the warp yarns to shift into new shed-forming positions. This process allows a new shed to be formed through which filling yarn can be inserted. As the above-described process is repeated, a fabric is woven.

It will be appreciated by those skilled in the art that various modifications and variations can be made in the present invention without departing from the scope of the invention. It is intended that the present invention include such modifications and variations as come within the scope of the appended claims and their equivalents.

What is claimed:

1. A shed forming device for creating a shed of warp yarns in a weaving machine, said device comprising:

a plurality of yarn separating elements, said yarn separating elements permitting said warp yarns to be separated into operational zones between said yarn separating elements and each of said yarn separating elements defining at least one opening therethrough with said at least one openings of said yarn separating elements being alignable to form at least one passageway;

a fluid supply apparatus connected to said plurality of yarn separating elements, said fluid supply apparatus supplying fluid so that said fluid is flowable through said at least one passageway; and wherein said yarn separating elements are configured to direct said fluid from said at least one passageway into said operational zones to contact said warp yarns, forcing said warp yarns to form changeable sheds to allow proper weaving.

2. A device as in claim 1, further comprising a control device in communication with said fluid supply apparatus, said control device controlling said flow of fluid from said fluid supply apparatus.

3. A device as in claim 2, wherein said at least one opening defined in each of said yarn separating elements comprises at least two upper openings in an upper portion of said yarn separating element and at least two lower openings in a lower portion of said yarn separating element, and thereby said at least one passageway comprises at least two upper passageways and at least two lower passageways through which fluid is flowable.

4. A device as in claim 3, wherein each of said yarn separating elements define channels extending from one of said upper openings in said upper portion to said operational zone and extending from one of said lower openings in said lower portion into said operational zone to direct said fluid flow.

5. A device as in claim 4, wherein said control device includes a control, control lines and control valves.

6. A device as in claim 5, wherein said control valves are interposed between said fluid supply apparatus and said passageways.

7. A device as in claim 6, wherein said control valves are disposed to fluid lines which connect said fluid supply apparatus with said passageways.

8. A device as in claim 7, wherein said control communicates with said control valves via said control lines, opening and closing said valves to selectively supply fluid to said passageways.

9. A device as in claim 5, wherein said control is a central processing unit.

10. A device as in claim 9, wherein said control is a programmable logic controller.

11. A device as in claim 9, wherein said control is a computer.

12. A device as in claim 1, wherein each of said yarn separating elements includes a divider plate for separating each of said warp yarns and at least one template for directing said fluid flows.

13. A device as in claim 12, wherein said at least one passageway is formed by aligning openings defined in said divider plates and said templates.

14. A device as in claim 13, wherein each of said separating elements includes an upper template disposed on an upper portion of said divider plate and a lower template disposed on a lower portion of said divider plate, said upper and lower templates directing said fluid to form said sheds.

15. A device as in claim 14, wherein each of said divider plates defines at least two openings in said upper portion and at least two openings in said lower portion.

16. A shed forming device for creating a shed of warp yarns in a weaving machine, said device comprising:

a plurality of yarn separating elements positionable within said weaving machine, each of said yarn separating elements including a divider plate for separating said warp yarns into operational zones between said divider plates and an upper template disposed on an upper portion of said divider plate and a lower template disposed on a lower portion of said divider plate;

each of said upper templates defining at least two openings which operably align with openings in said upper portions of said divider plates, and each of said lower templates defining at least two openings which operably align with openings in said lower portions of said divider plates, thereby producing passageways formed by the aligned openings in said divider plates and said upper templates and said lower templates, respectively;

a fluid supply apparatus connected to said plurality of yarn separating elements, said fluid supply apparatus supplying fluid so that said fluid is flowable through said passageways; and wherein said upper and lower templates are configured to direct said fluid to contact said warp yarns, forcing said warp yarns to form changeable sheds to allow proper weaving.

17. A device as in claim 16, wherein individual upper and lower templates include a channel leading from one of said openings defined by said templates through said templates into said operational zone between said divider plates.

18. A device as in claim 17, wherein said fluid supply apparatus provides a fluid which flows through said passageways formed by divider plates and templates and down said channels formed in said templates so as to cause said warp yarns in said operational zone to form a shed.

19. A device as in claim 18, further comprising a control device for controlling said fluid supply apparatus to selectively provide said fluid to said passageways formed by the aligned openings of said divider plates, and said templates in said upper and lower portions at predetermined intervals.

20. A device as in claim 19, further comprising an outer frame operably disposed to said plurality of yarn separating elements.

21. A device as in claim 20, wherein said outer frame includes at least two side elements, said outer frame defining at least two openings in an upper portion and at least two openings in a lower portion within at least one of said side elements.

22. A device as in claim 19, wherein said fluid supply apparatus is operably configured with said outer frame.

23. A device as in claim 19, wherein said control device includes a control, control lines and control valves.

24. A device as in claim 23, wherein said control valves are interposed between said fluid supply apparatus and said passageways.

25. A device as in claim 24, wherein said control valves are disposed to fluid lines which connect said fluid supply apparatus with said passageways.

26. A device as in claim 25, wherein said control communicates with said control valves via said control lines, opening and closing said valves to selectively supply fluid to said passageways.

27. A device as in claim 23, wherein said control is a central processing unit.

28. A device as in claim 27, wherein said control is a programmable logic controller.

29. A device as in claim 27, wherein said control is a computer.

30. A device as in claim 1, wherein said fluid is air.

31. A device as in claim 1, wherein said fluid is water.

32. A device as in claim 1, wherein an individual warp yarn extends within each operational zone between said yarn separating elements.

33. A shed forming device for creating a shed of warp yarns in a weaving machine, said device comprising:

a plurality of spaced yarn separating elements carried within said weaving machine, said spaced yarn separating elements defining individually spaced operational zones through which said warp yarns extend in yarn paths;

a fluid supply source supplying fluid;

a first fluid direction member carried on an upper portion of each of said yarn separating elements, said first fluid direction member directing fluid in a first direction;

a second fluid direction member carried on a lower portion of each of said yarn separating elements, said second fluid direction member directing fluid in a second direction;

a plurality of valves interposed between said fluid supply source and said fluid direction members;

a control operably connected to said valves, said control selectively opening and closing said valves to selectively supply fluid through said first and second direction members against said warp yarns forcing said warp yarns to form a shed.

34. A device as in claim 33, wherein said fluid direction members are air jets.

35. A device as in claim 33, wherein said fluid direction members are water jets.

36. A device as in claim 33, wherein said fluid direction members are channels.

37. A device as in claim 36, wherein each of said yarn separating elements defining at least two upper openings in an upper portion of said yarn separating element and at least two lower openings in a lower portion of said yarn separating element.

38. A device as in claim 37, wherein said upper and lower openings defined by each of said yarn separating elements align to form passageways through which said fluid flows.

39. A device as in claim 38, wherein each of said first fluid direction member extend from one of said upper openings in said upper portion to said respective operational zone and each of said second fluid direction member extend from one of said lower openings in said lower portion into said respective operational zone.

40. A device as in claim 33, wherein a fluid path directed by said fluid direction members forms an acute angle with the yarn paths of said warp yarns.

41. A device as in claim 33, further comprising spacers elements carried between said yarn separating elements.

42. A device as in claim 41, wherein said spacers elements are position above and below said yarn paths of said warp yarns.

43. A device as in claim 33, wherein said yarn separating elements possess a first inward curve on a side of said yarn separating element where the warp yarns enter said operational zone.

44. A device as in claim 43, wherein said yarn separating elements possess a second inward curve on a side of said yarn separating element where the warp yarns exit said operational zone.

45. A device as in claim 44, wherein said first inward curve on said side of said yarn separating element where the warp yarns enter said operational zone extends in an acute angle, and said second inward curve on said side of said yarn separating element where the warp yarns exit said operational zone extends in an obtuse angle.

46. A shed forming device for creating a shed of warp yarns in a weaving machine, said device comprising:

an outer frame having at least two side elements, said outer frame having at least two openings in an upper portion and at least two openings in a lower portion within at least one of said side elements;

a plurality of divider plates carried within said outer frame, said divider plates having at least two openings in upper portions and at least two openings in lower portions operably aligned with said openings formed by said at least one side element of said outer frame;

a plurality of upper templates individually configured between said plurality of dividers plates, said upper templates having at least two openings which operably align with openings in said upper portions of said divider plates, thereby producing passageways formed by the aligned openings of said outer frame, divider plates, and upper templates, respectively;

a plurality of lower templates individually configured between said plurality of dividers plates, said lower templates having openings which operably align with specified openings in said lower portions of said divider plates, thereby producing passageways formed by the aligned openings of said outer frame, divider plates, and lower templates, respectively;

a channel provided in each of said templates communicating with an opening in each of said templates;

said warp yarns extending between said divider plates;

a fluid supply apparatus operably connected to said outer frame, said fluid supply apparatus supplying fluid to said openings of said outer frame, whereby said fluid travels through said passageways formed by said outer frame, divider plates, and templates; and a control device operably connected to said fluid supply apparatus, said control device controlling said fluid supply apparatus so as to selectively supply said fluid to said passageways formed by the aligned openings of said outer frame, said divider plates, and said templates in said upper and lower portions in such a manner that said fluid travels through said channels leading from said openings of said selected passageways pushing said warp yarns into a shed.

47. A device as in claim 46, wherein an individual warp yarn extends within each operational zone between said yarn separating elements.

48. A method of forming a shed of warp yarns for a weaving operation, said method comprising the steps of:

placing warp yarns into separate operational zones of a shed-forming device;

supplying flows of fluids at predetermined intervals to interact with the separated warp yarns; and directing the flows of fluid to contact the separated warp yarns to force the separated warp yarns to move into a shed-forming position to allow filling yarn insertion through the formed shed.

49. A method as in claim 48, wherein the directed flows of fluid push the separated warp yarns into a shed forming position.

50. A method as in claim 48, wherein at least two upper flows of fluid are provided in an upper position above the warp yarns, and at least two lower flows of fluid are provided in a lower position below the warp yarns.

51. A method as in claim 50, wherein the upper flows of fluid push the warp yarns into a downward shed position, and the lower flows of fluid push the warp yarns in a upward shed position.

52. A method as in claim 51, further comprising controlling the flows of fluid in such a manner that each upper flow of fluid inversely corresponds to a lower flow of fluid, so that when an upper flow of fluid is active, then the corresponding lower flow of fluid is inactive and when an upper flow of fluid is inactive, then the corresponding lower flow of fluid is active.

53. A method as in claim 52, wherein the individual warp yarns are assigned to a set of warp yarns, thereby forming a plurality of sets of warp yarns that correspond to the number of upper flows of fluid or the number of lower flows of fluid.

54. A method as in claim 53, wherein each upper flow of fluid from the at least two flows of fluid in the upper position and its inversely corresponding lower flow of fluid engages one set of warp yarns of the plurality of sets of warp yarns.

55. A method as in claim 48, wherein the flow of fluid is a flow of air.

56. A method as in claim 48, wherein the flow of fluid is a flow of water.

57. A weaving machine for weaving a fabric, said weaving machine comprising:

a warp beam disposed on one end of said weaving machine, said warp beam containing a plurality of warp yarns which extend therefrom;

a take-up roll disposed on the opposite end of said weaving machine from said warp beam, said take up roll receiving said fabric that is being woven on said weaving machine;

a plurality of yarn separating elements disposed between said warp beam and said take-up roll, said yarn separating elements individually separating said warp yarns into operational zones between said yarn separating elements and each of said yarn separating elements defining at least one opening therethrough with said at least one openings of said yarn separating elements being alignable to form at least one passageway;

a fluid supply apparatus connected to said plurality of yarn separating elements, said fluid supply apparatus supplying fluid so that said fluid is flowable through said at least one passageways; and wherein said yarn separating elements are configured to direct said fluid from said at least one passageway into said operational zones to contact said warp yarns, forcing said warp yarns to form changeable sheds to allow filling insertion.

58. A weaving machine as in claim 57, further comprising a control device in communication with said fluid supply apparatus, said control device controlling said flow of fluid from said fluid supply apparatus.

59. A weaving machine as in claim 58, wherein said at least one opening defined in each of said yarn separating elements comprises at least two upper openings in an upper portion of said yarn separating element and at least two lower openings in a lower portion of said yarn separating element, and thereby said at least one passageway comprises at least two upper passageways and at least two lower passageways through which fluid is flowable.

60. A weaving machine as in claim 59, wherein each of said yarn separating elements define channels extending from one of said upper openings in said upper portion to said operational zone and extending from one of said lower openings in said lower portion into said operational zone to direct said fluid flow.

61. A weaving machine as in claim 60, wherein said control device includes a control, control lines and control valves.

62. A weaving machine as in claim 61, wherein said control valves are interposed between said fluid supply apparatus and said passageways.

63. A weaving machine as in claim 62, wherein said control valves are disposed to fluid lines which connect said fluid supply apparatus with said passageways.

64. A weaving machine as in claim 63, wherein said control communicates with said control valves via said control lines, opening and closing said valves to selectively supply fluid to said passageways.

* * * * *